US009342012B2

(12) United States Patent
Taki

(10) Patent No.: US 9,342,012 B2
(45) Date of Patent: May 17, 2016

(54) SHEET DISCHARGE TRAY, SHEET DISCHARGE MECHANISM AND DECOLORIZATION DEVICE

(71) Applicants: KABUSHIKI KAISHA TOSHIBA, Minato Tokyo (JP); TOSHIBA TEC KABUSHIKI KAISHA, Shinagawa Tokyo (JP)

(72) Inventor: Hiroyuki Taki, Kannami Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/322,742

(22) Filed: Jul. 2, 2014

(65) Prior Publication Data

US 2016/0004200 A1 Jan. 7, 2016

(51) Int. Cl.

| | |
|---|---|
| ***B65H 31/34*** | (2006.01) |
| ***B65H 31/36*** | (2006.01) |
| ***B65H 31/20*** | (2006.01) |
| ***G03G 15/20*** | (2006.01) |
| ***B65H 43/00*** | (2006.01) |
| ***B65H 31/26*** | (2006.01) |

(52) U.S. Cl.

CPC ..... *G03G 15/2085* (2013.01); *B65H 31/20* (2013.01); *B65H 31/26* (2013.01); *B65H 31/34* (2013.01); *B65H 31/36* (2013.01); *B65H 43/00* (2013.01)

(58) Field of Classification Search

CPC ..... B65H 31/36; B65H 31/26; B65H 31/20; B65H 31/34

See application file for complete search history.

(56) References Cited

U.S. PATENT DOCUMENTS

| | | | |
|---|---|---|---|
| 8,177,213 | B2 | 5/2012 | Hirabayashi |
| 2011/0222951 | A1 | 9/2011 | Yahata et al. |
| 2012/0306144 | A1 | 12/2012 | Taki et al. |
| 2013/0003134 | A1 | 1/2013 | Hazu et al. |

FOREIGN PATENT DOCUMENTS

| | | | |
|---|---|---|---|
| JP | 05229716 A | * | 9/1993 |
| JP | 2009161311 A | * | 7/2009 |

* cited by examiner

*Primary Examiner* — Luis A Gonzalez

(74) *Attorney, Agent, or Firm* — Patterson & Sheridan, LLP

(57) ABSTRACT

A sheet discharge tray according to an embodiment includes a loading board that receives sheets that are discharged from a sheet transport path. A first contact alignment board is vertically positioned on the loading board at a first end portion on an upstream side in a sheet discharge direction. A second, contact alignment board is vertically positioned on the loading board at a second end portion on a downstream side in the sheet discharge direction. An alignment roller aligns sheets that are less than or equal to a predetermined size to abut against the first contact alignment board. The alignment roller aligns sheets that are greater than the predetermined size to abut against the second contact alignment board.

20 Claims, 12 Drawing Sheets

SHEET DISCHARGE TRAY, SHEET DISCHARGE MECHANISM AND DECOLORIZATION DEVICE

FIELD

Embodiments described herein relate generally to a device that loads discharged sheets.

BACKGROUND

In the related art, techniques are known in which sheets discharged onto a discharge tray are caused to abut against a predetermined contact hoard using an alignment roller, and are aligned at an end portion on a downstream side in a sheet transport direction with bundles of sheets that are discharged into the discharge tray. In this case, in order to align sheets of a predetermined size, it is necessary to provide a regulation board at a position that matches the sheet size, and a problem arises in that it is not possible to mix sheets of differing sizes in a single tray. In addition, when sheets with sizes that differ greatly from one another (for example, A3 size and postcard size) are discharged, it is difficult to align sheets of various sizes via abutment thereof against the same contact board with a single alignment roller.

DETAILED DESCRIPTION

A sheet discharge tray according to an embodiment includes a loading board that receives sheets that are discharged from a sheet transport path. A first contact alignment board is vertically positioned on the loading board at a first end portion on an upstream side in a sheet discharge direction. A second contact alignment board is vertically positioned on the loading board at a second end portion on a downstream side in the sheet discharge direction. An alignment roller aligns sheets that are less than or equal to a predetermined size to abut against the first contact alignment board. The alignment roller aligns sheets that are greater than the predetermined size to abut against the second contact alignment board.

According to the embodiment, baaed on the size of a discharged sheet, the sheet may be aligned on either an upstream side in the discharge direction or a downstream side in the discharge direction in the sheet discharge tray. As a result of this configuration, it may be possible to mix sheets of various sizes in a single tray using a single alignment roller without having to provide a regulation board at a position that matches the sheet size.

Hereinafter, the present embodiment will be described with reference to the drawings.

(First Embodiment)

Figure 1:
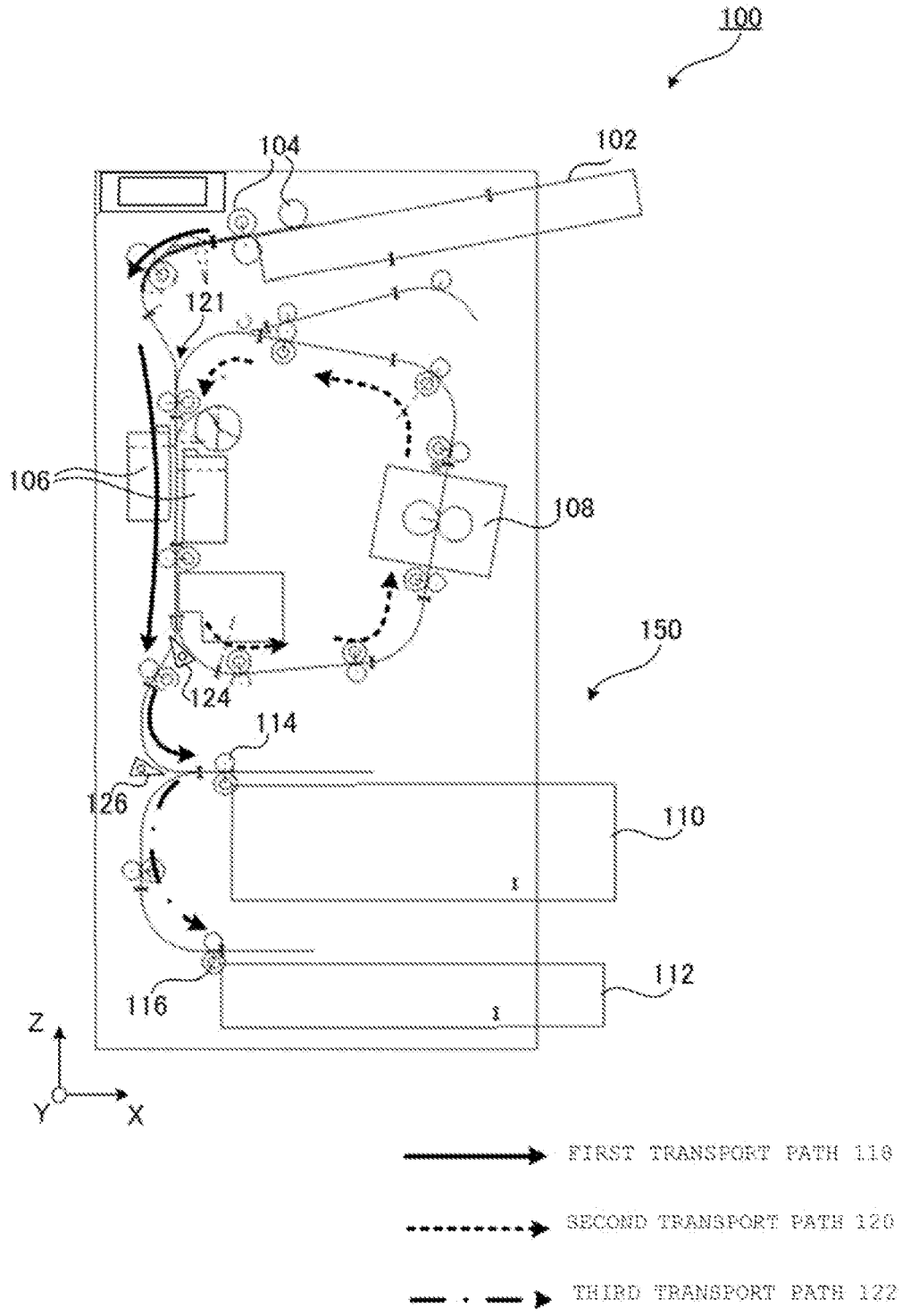
FIG. 1 is a schematic view of a decolorization device.

FIG. 1 is a schematic view of a decolonization device 100.

The decolorization device 100 is provided with a paper supply tray 102, a paper supply roller 104, a scanning unit 106, a decolorization unit 108, a discharge unit 150, a first transport path 118, a second transport path 120, a third transport path 122 and a first separator 124. The discharge unit 150 includes a first-discharge tray 110, a second discharge tray 112, a first discharge roller 114, a second discharge roller 116 and a second separator 126.

Sheets loaded into the paper supply tray 102 are sheets on which images are formed using a decolorizable toner. The sheets are transported to the first transport path 118 by the paper supply roller 104, and pass through the scanning unit 106. In this case, a decolorizable toner refers to a toner in which the color thereof disappears when heated to a predetermined temperature.

Two scanning units 106 are positioned to mutually face one another on opposite sides of the first transport path 118. The scanning units 106 read images that are formed on both surfaces of sheets that pass therethrough, image data read by the scanning unit 106 is stored in a storage unit 600 (refer to FIG. 2).

Sheets that have passed through the scanning unit 106 are guided to the second transport path 120 or the first discharge tray 110 by the first separator 124. When images are formed on the sheet, the first separator 124 transports the sheet to the second transport path 120. On the other hand, when images are not formed on the sheet, the first separator 124 guides the sheet to the first discharge tray 110.

Sheets that are transported to the second transport path 120 undergo a decolorization treatment (by being heated in the decolorization unit 108), and converge with the first transport path 118 at a convergence point 121. After converging with the first transport path 118, the sheets are scanned again by the scanning unit 106.

When sheets pass through the scanning unit 106 for the second time, the second separator 126 guides the sheets to the first discharge tray 110 when images that are formed on the sheets are removed. When images that are formed on the sheets are not removed, the second separator 126 guides the sheets to the third transport path 122, and the sheets are transported to the second discharge tray 112.

Figure 2:
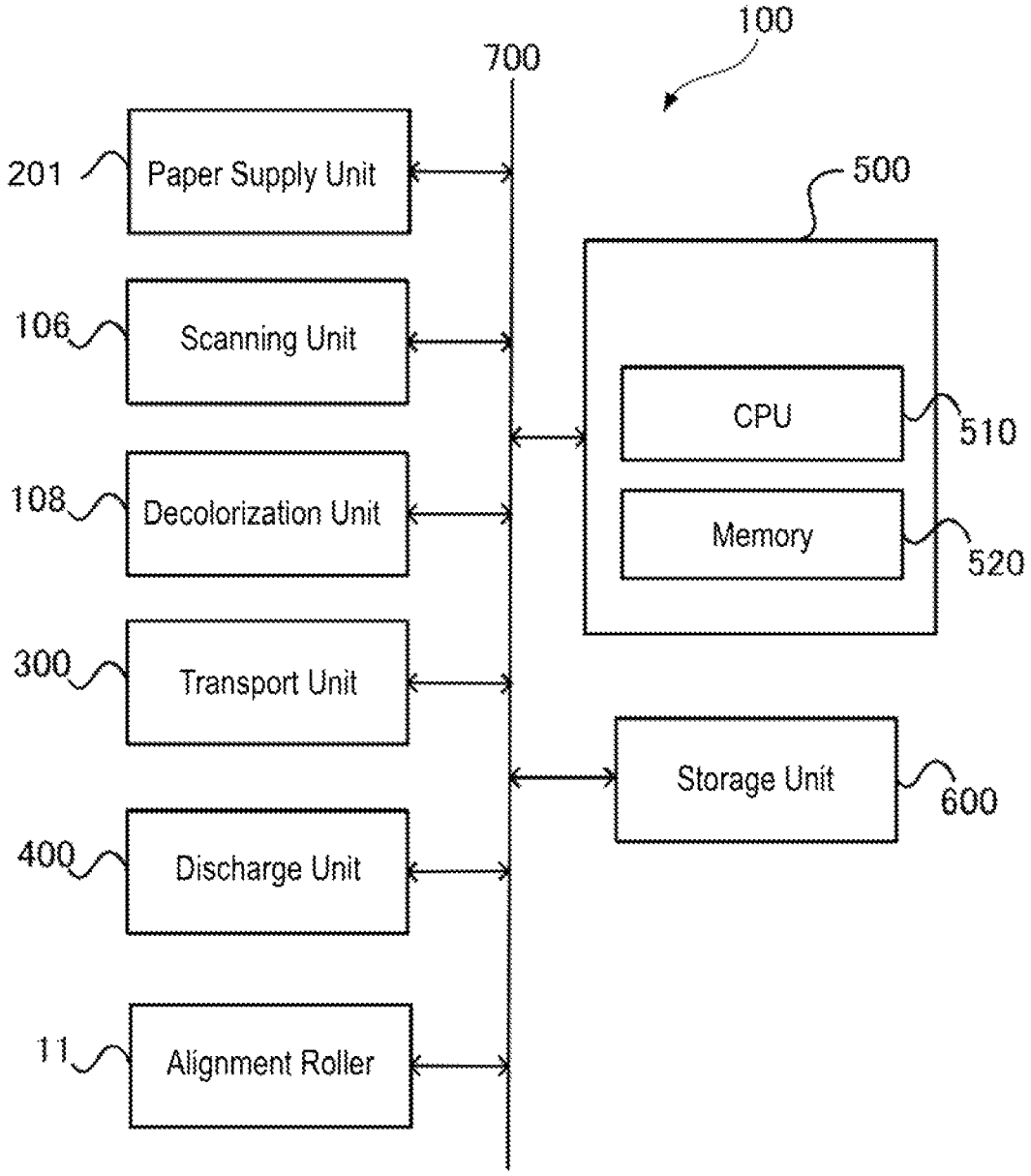
FIG. 2 is a block diagram illustrating a hardware configuration of the decolorization device.

FIG. 2 is a block diagram illustrating a hardware configuration of the decolorization device 100.

In the decolorization device 100, a paper supply unit 201, the scanning unit 106, the decolorization unit 108, a transport unit 300, a discharge unit 400, an alignment roller 11, a control unit 500, the storage unit 600 and a size information acquisition unit 800 are mutually connected through a communication bus 700.

In this case, the paper supply unit 201 includes the paper supply tray 102 and the paper supply roller 104, and supplies sheets loaded in the paper supply tray 102 to the inside of the first transport path 118. The transport unit 300 includes the first separator 124, the second separator 126 and a transport roller (not shown in the drawings), and transports sheets that are inside the first to third transport paths. The discharge unit 400 includes the first discharge tray 110, the second discharge tray 112, the first discharge roller 114 and the second discharge roller 116, and discharges sheets on which a decolorization treatment is performed to a discharge tray (the first discharge tray 110 or the second discharge tray 112).

The control unit 500 includes a CPU 510 and a memory 520. The operation of the decolorization device 100 is controlled by the CPU 510 executing computer programs stored in the memory 520. The memory 520 includes a Read Only Memory (ROM), a Random Access Memory (RAM), an Electrically Erasable Programmable Read-Only Memory (EEPROM) or the like. The memory 520 is used to store computer programs that control of the decolonization device 100, as well as various types of data that is created when the computer programs are executed. The computer programs read by the memory 520 are read and executed, by the control unit 500. The storage unit 600 stores image data and the like that is scanned by the scanning unit 106.

Figure 3:
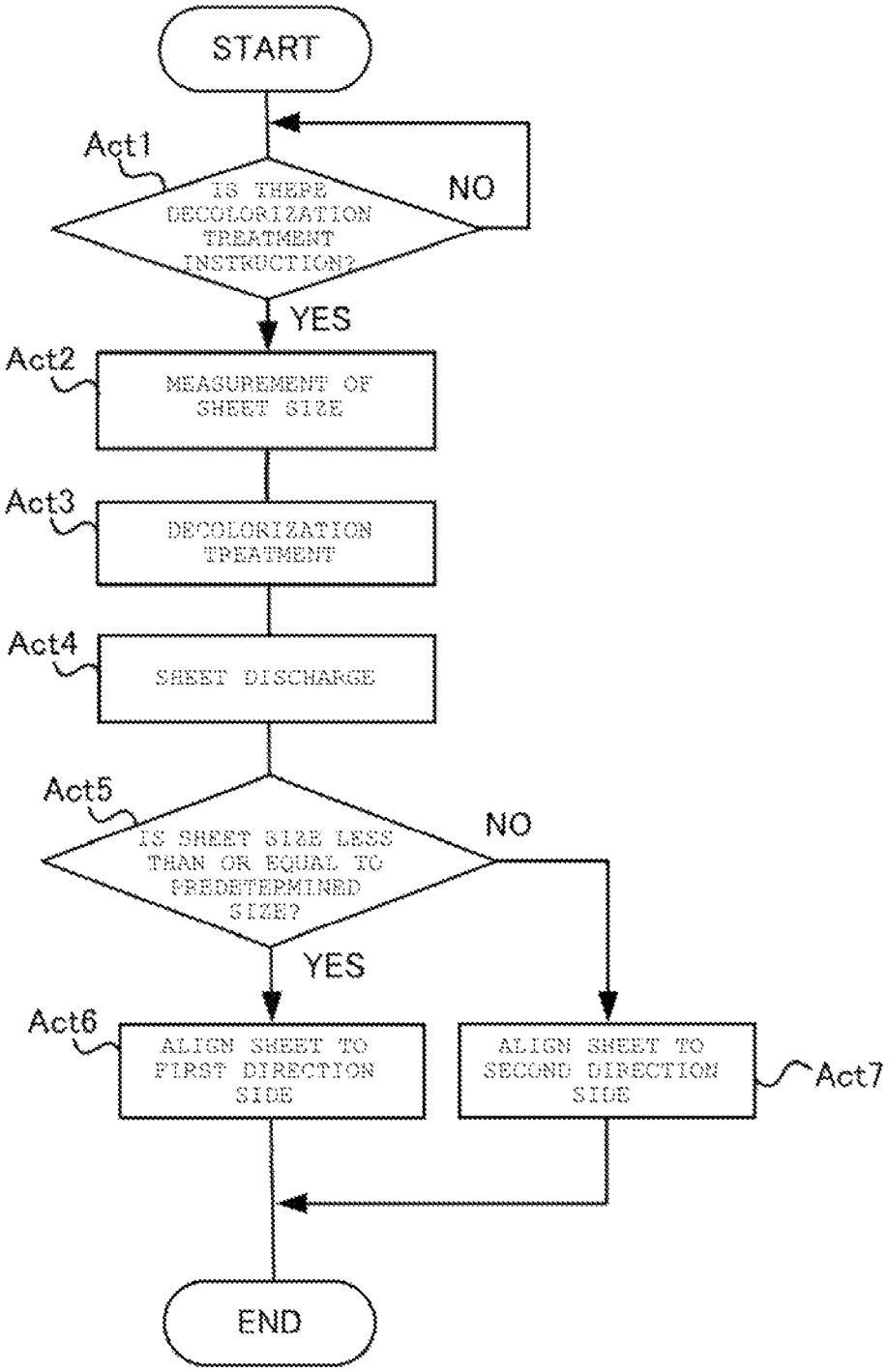
FIG. 3 is a flowchart illustrating a flow of a decolonization process in the decolorization device.

FIG. 3 is a flowchart illustrating a flow of an operation of the decolorization device 100.

In Act1, when a user instructs the decolorization device 100 to execute a decolorization treatment, the process proceeds to Act2 (Yes in Act1). On the other hand, when a user does not instruct the decolorization device 100 to execute a decolorization treatment, the process does not proceed to Act2 (Act1, No).

In Act 2, the control unit 500 (the size information acquisition unit) that received the instruction to execute a decolorization treatment measures the sheet size of a sheet on which a decolorization treatment is to be performed. More specifically, the control unit 500 (the sire information acquisition unit) measures the length of the sheet in a transport direction by measuring a number of rotations of the paper supply roller 104 when the sheet is supplied. Alternatively, it is also possible to measure the sheet size in the scanning unit 106. It is possible to measure the sizes of all of the sheets in the scanning unit 106. Additionally, in the present embodiment, the method for measuring sheet size is not limited to measuring using the paper supply roller or the scanning unit, but for example, the sheet size may be measured using a roller other than the paper supply roller. Information related, to the measured sheet size is stored in the memory 520 (refer to FIG. 2).

In Act3, the decolorization device 100 performs a decolorization treatment on the sheet as a result of the control unit 500 controlling the operation of the decolorization device 100. The details of the decolorization treatment are as described above. The decolorization treatment in Act3 refers to a treatment after a sheet is supplied.

In Act4, the discharge unit 400 discharges a sheet upon which a decolorization treatment is performed to a discharge tray (the first discharge tray 110 or the second discharge tray 112) as a result of the control unit 500 controlling the discharge unit 400. As described above, the first discharge roller 114 transports the sheet on which the image is removed to the first discharge tray 110, or the second discharge roller 116 transports the sheet on which the image is not removed to the second discharge tray 112.

In Act5, when the size of a sheet on which a decolorization treatment is performed is less than or equal, to a predetermined size, the process proceeds to Act6 (Yes in Act5). On the other hand, when the size of a sheet on which a decolonization treatment is performed is greater than a predetermined size, the process proceeds to Act7 (Act5, No). The predetermined size will be described in detail later in connection with FIG. 8.

Figure 4:
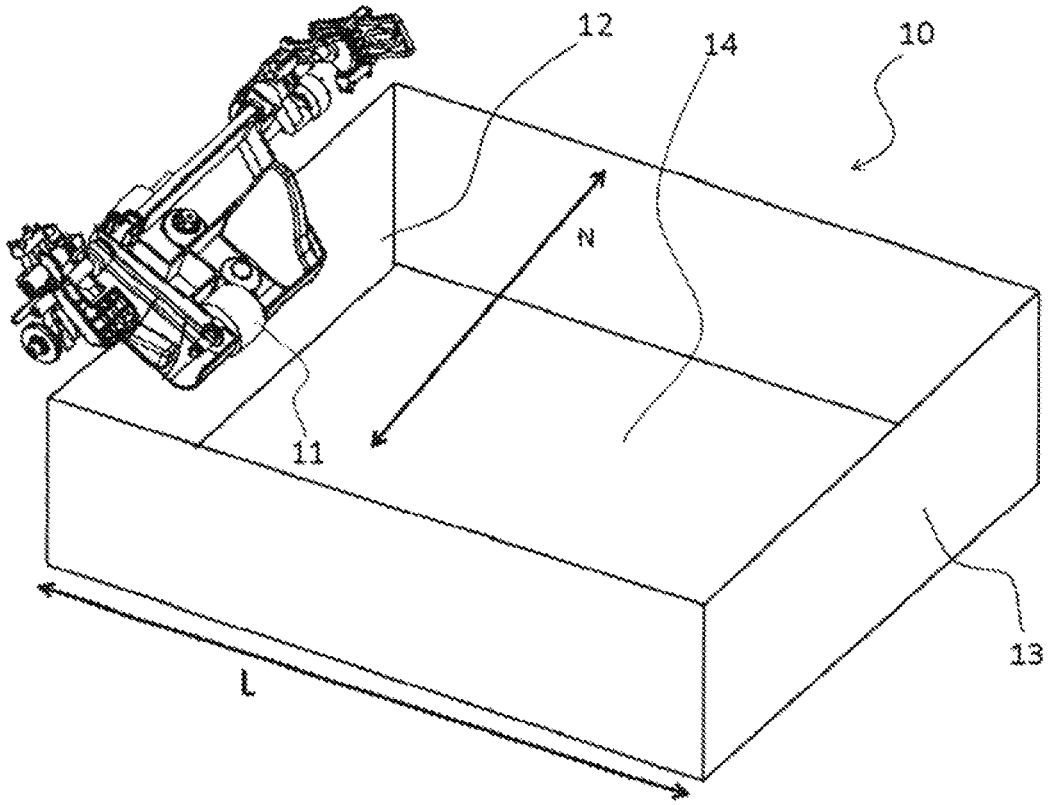
FIG. 4 is a perspective view of a discharge tray, according to a first embodiment.

In Act6, the alignment roller 11 aligns a discharged sheet to a first side (upstream side in the sheet discharge direction) as a result of the control unit 500 controlling the alignment roller 11 (refer to FIG. 4). The sheet alignment operation will be described in detail later.

In Act7, the alignment roller 11 aligns a discharged sheet to a second side (downstream in the sheet discharge direction) as a result of the control unit 500 controlling the alignment roller 11. The sheet alignment operation will be described in detail later.

Next, an alignment method of a sheet that is discharged to the first discharge tray 110 (refer to FIG. 1) will be described. However, a sheet discharge mechanism 10 is not necessarily limited to being adopted in the first discharge tray 110 only, but it is also possible to adopt the sheet discharge mechanism 10 in the second discharge tray 112.

Figure 5:
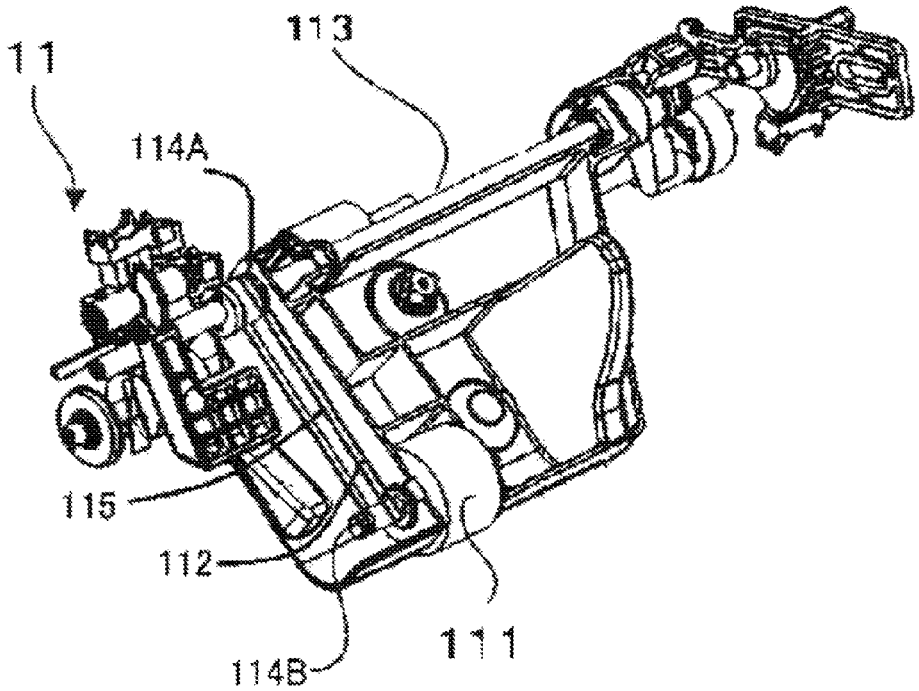
FIG. 5 is a perspective view of an alignment roller used in conjunction with the discharge tray, according to the first embodiment.
Figure 6:
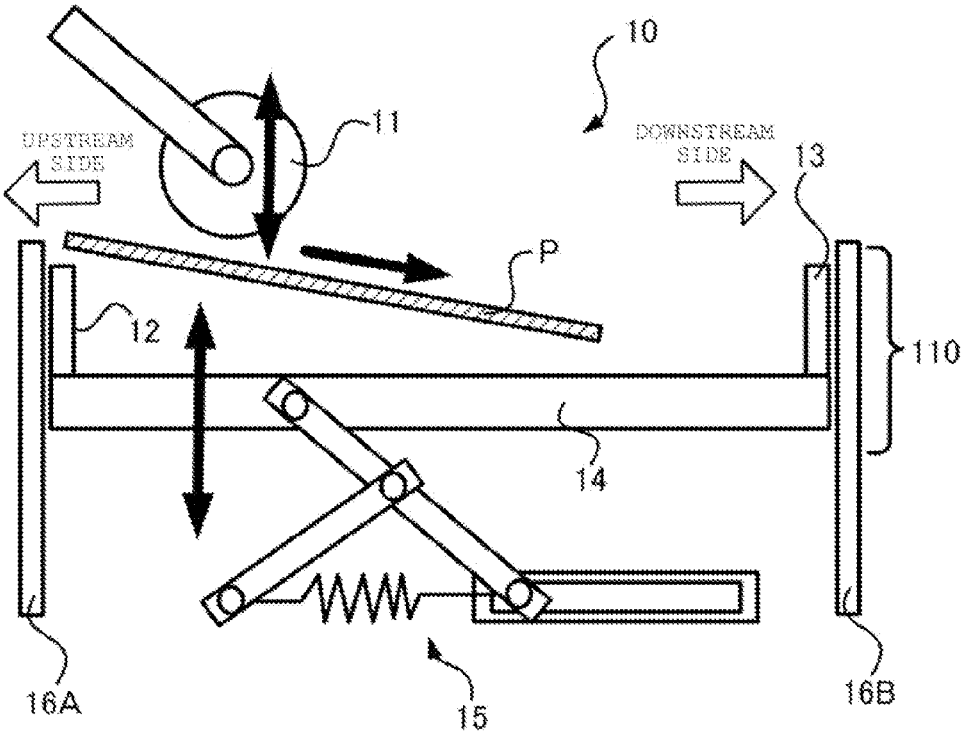
FIG. 6 is a schematic view of a sheet discharge mechanism, according to the first embodiment.

FIG. 4 is a perspective view illustrating the sheet discharge mechanism 10 according to the first embodiment. FIG. 5 is a perspective view illustrating the alignment roller 11. FIG. 6 is a schematic view illustrating the sheet discharge mechanism 10, according to the first embodiment. A sheet P on which a decolorization treatment is performed (refer to FIG. 6) is discharged to the sheet discharge mechanism 10, and the sheet P is aligned. The sheet discharge mechanism 10 includes the alignment roller 11, a first contact alignment board 12, a second contact alignment board 13, a loading board 14 and a support mechanism 15 (refer to FIG. 6). The loading board 14 receives a sheet P on which a decolorization treatment is performed and which is discharged from the sheet transport path on a sheet loading surface (not shown in the drawings) thereof. The alignment roller 11 transports the sheet P to an upstream side in a sheet discharge direction of the loading board 14 (hereinafter referred to as an "upstream side") or a downstream side in the sheet discharge direction of the loading board 14 (hereinafter referred to as a "downstream side") by rotating the sheet P while applying pressure thereto. The first contact alignment board 12 is a board for regulating the transport of the sheet P to the upstream side, and is vertically arranged on the upstream side of the loading board 14. In addition, the second contact alignment board 13 is a board for regulating the transport of the sheet P to the downstream side, and is vertically arranged on the downstream side of the loading board 14. In addition, the support mechanism 15 is a mechanism for elastically supporting the first sheet discharge tray 110, and supports the first discharge tray 110 to descend according to increases in the weight of sheets P. However, the mechanism of the support, mechanism 15 in not limited to that illustrated in FIG. 6, but it is sufficient to support the first discharge tray to descend according to increases in the weight of sheets P. In addition, a guide board 16B (refer to FIG. 6) is vertically arranged to be close to the second contact alignment board 13 on the downstream side of the second contact alignment board 13 in the sheet discharge direction. Furthermore, a guide board 16A (refer to FIG. 65 is vertically arranged to be close to the first contact alignment board 12 on the upstream side of the first contact alignment board 12 in the sheet discharge direction. Movement of the first discharge tray 110 on the upstream side in the sheet discharge direction and the downstream side thereof is regulated by the vertical arrangement of the guide boards 16A and 16B. As a result of this configuration, the first discharge tray 110 is only moveable in a vertical direction.

Next, the alignment roller 11 will be described using FIG. 5.

Firstly, a shaft 113 rotates due to the driving of a motor 116. When the shaft 113 rotates, a pulley 114A that is fixed to the shaft 113 also rotates. A belt 112 is attached to the pulley 114A and a pulley 114B, and causes the pulley 114B to rotate when the pulley 114A rotates. The pulley 114B is connected to a roller 111 via a shaft (not illustrated in the drawings), and the torque of the pulley 114B is transmitted to the roller 111. According to this mechanism, the torque from the motor 116 is transmitted to the roller 111. In addition, a roller support unit 115 is attached to the shaft 113 in a rotatable state, and the roller support unit 115 also rotates in sync with the movement of the belt 112.

Figure 7:
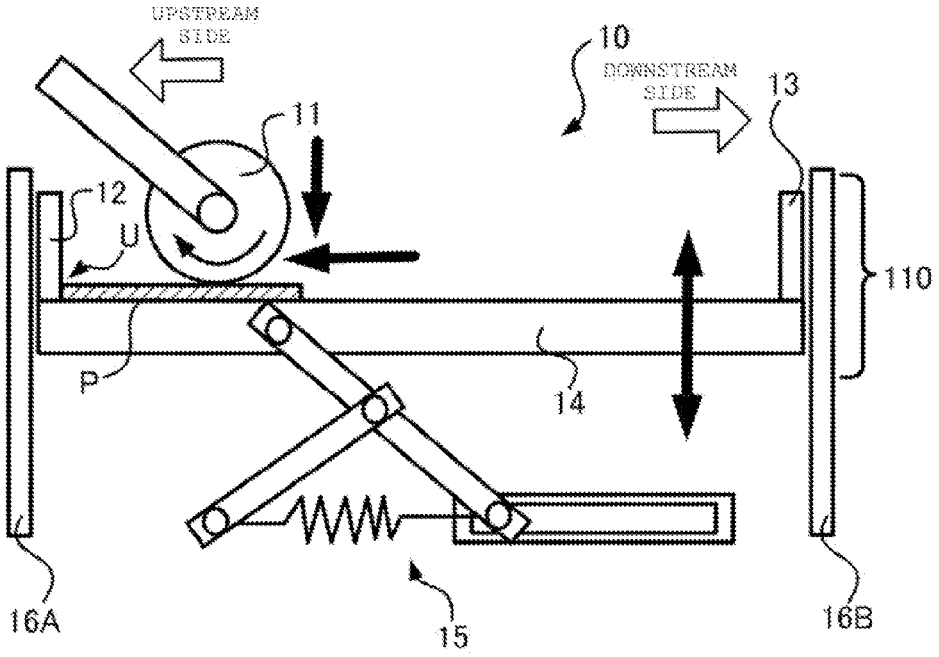
FIG. 7 illustrates the sheet discharge mechanism in a state in which sheets are aligned on an upstream side in a sheet discharge direction, according to the first embodiment.

FIG. 7 is a view illustrating a state in which sheets P are aligned on an upstream side.

As described, above, when the size of a discharged sheet P is less than or equal to a predetermined size, the sheet P is aligned on the upstream side on the first sheet discharge tray 110 (Yes in Act5 in FIG. 3).

Firstly, the sheet P on. which a decolorization treatment is performed is discharged to a sheet loading surface of the loading board 14. When the sheet P is discharged onto the loading board 14, the alignment roller 11 descends. The descended alignment roller 11 rotates while applying pressure to the sheet P and transports the sheet P to the upstream side. At this time, the alignment roller 11 rotates to transport the sheet P to the upstream side. The sheet P that is transported to the upstream side is aligned by being abutted against the first contact alignment board 12. That is, an end on the upstream side in the sheet discharge direction of the sheet p is arranged at a position U where the sheet P abuts against the first contact alignment board 12, as a result of the sheet P abutting against the first contact alignment board 12.

In this case, when a length of the first sheet discharge tray 110 in the sheet discharge direction is set as a length L (refer to FIG. 4), it is sufficient if the length L is a length in which it is possible to load the maximum size of a sheet P among a group of sheets that is discharged into the sheet discharge tray. For example, when the maximum size of the sheet is A4 , it is necessary that the length L be a length that may accommodate sheets of A4 size.

In addition, the structure of the support mechanism 15 is not necessarily limited to the structure that is illustrated in FIG. 6. It is sufficient if the support mechanism 15 has a structure in which the loading board 14 descends based on increases in the weight of sheets P that are loaded on the loading board 14. According to this configuration, it is even possible to avoid a situation in which discharged sheets P come into contact with loaded sheets P when a large number of sheets P are loaded on the loading board 14. Thus, it is possible to avoid jamming.

In addition, if a length of the sheet discharge tray 110 in a direction that is orthogonal to the discharge direction of the sheets (a width of the sheet discharge tray 110) is set as a width N (refer to FIG. 4), in the same manner as the length L, it is necessary that the width N be a width in which it is possible to load the maximum size of a sheet among a group of sheets that is discharged into the sheet discharge tray 110.

In addition, in the first embodiment, a sheet loading surface of the loading board 14 is flat. However, the sheet loading surface need not necessarily be flat, and may take any form, provided the sheets P may be loaded thereon.

Figure 8:
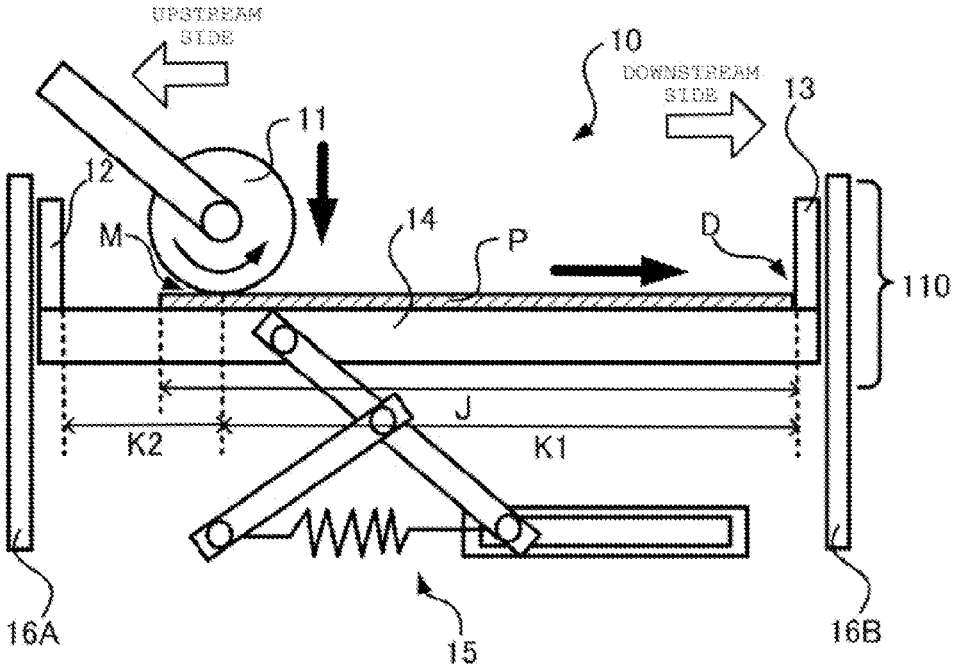
FIG. 8 illustrates the sheet discharge mechanism in a state in which sheets are aligned on a downstream side in a sheet discharge direction, according to the first embodiment.

FIG. 8 is a view illustrating a state in which sheets P are aligned on a downstream side.

When the size of a discharged sheet P is greater than the predetermined size, the sheet P is aligned on the downstream side on the first sheet discharge tray 110.

When the sheet P is discharged onto the loading board 14, the alignment roller 11 descends. The descended alignment roller 11 rotates while applying pressure to the sheet P and transports the sheet P to the downstream side. At this time, the alignment roller 11 rotates to transport the sheet P to the downstream, side. A sheet P transported to the downstream side is aligned by being abutted against the second contact alignment board 13. That is, an end on the downstream side in the sheet discharge direction of the sheet P is arranged at a position D, where the sheet P abuts against the second contact alignment board 13, as a result of the sheet P abutting against the second contact alignment board 13.

Next, the predetermined size that forms a reference for discriminating between sheet alignment directions will be described. The alignment roller 11 aligns sheets P that are less than or equal to the predetermined size on the upstream side and aligns sheets P that are greater than the predetermined size on the downstream side. In this case, a position at which the alignment roller 11 applies pressure to the sheets P is set as a pressurization position M, a distance from the pressurization position M to the second contact alignment board 13 is set as a distance K1 and a distance from the pressurization position M to the first contact alignment board 12 is set as a distance K2 . When a length J of a sheet P in the sheet discharge direction is greater than or equal to K1 , the alignment roller 11 aligns the sheet P on the downstream side. On the other hand, when the length J is not greater than or equal to K1 , the alignment roller 11 aligns the sheet P on the upstream side. If sheets P of which the length J is not greater than or equal to K1 are aligned on the downstream side, the sheets P are separated from the alignment roller when the sheets P abut against the second contact alignment board, and thus, it is not possible to accurately align the sheets P. That is, the predetermined size refers to the size of sheets P of which the length in the sheet discharge direction is K1 , and sheets P that may be aligned by the alignment roller 11 are aligned on the downstream side. When sheets P that are transported in the sheet discharge direction are transported in a direction opposite to the sheet discharge direction, there is a deterioration in productivity, as compared with a case of transporting in a sheet discharge direction. That is, instead of aligning sheets P of all sizes on the upstream side, by aligning sheets P, which may be aligned on the downstream side in the sheet discharge direction, on the downstream side, it is possible to mix sheets P of differing sizes in a single sheet discharge tray 110 without a deterioration in productivity.

Figure 9:
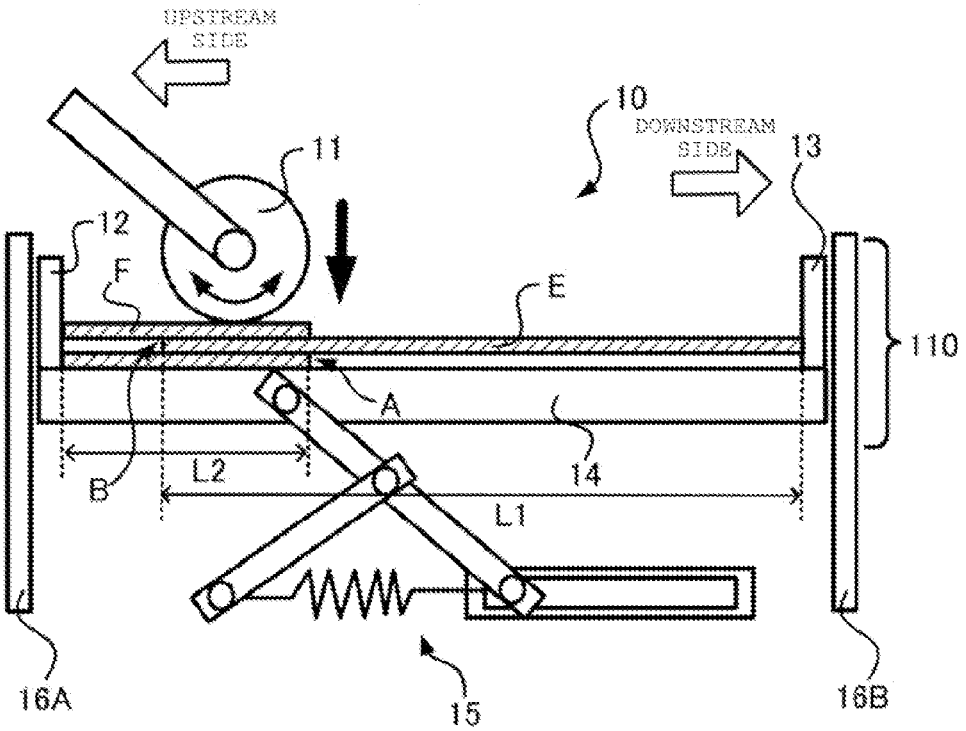
FIG. 9 illustrates the sheet discharge mechanism in a state in which sheets are aligned on both an upstream side and a downstream side in a sheet discharge direction, according to the first embodiment.

FIG. 9 is a view illustrating a state in which sheets P of differing sizes are mixed in the first sheet discharge tray 110.

As described above, sheets P are aligned on the upstream side if the size of the sheet P is less than or equal to the predetermined size, and are aligned on the downstream side if the size of the sheet P is greater than the predetermined size. As a result of this configuration, it is possible to mix sheets of differing sizes in a single sheet discharge tray without it being necessary to provide a contact alignment board at a position that matches the sheet size.

In this case, it is necessary that the alignment roller 11 be disposed in a position in which it is possible to align all groups of sheets that are discharged to the sheet discharge tray. A length of the sheet discharge tray 110 in the sheet discharge direction is set as L, a length in the sheet discharge direction of a sheet E, which is a maximum size of sheet among a group of sheets that is loaded into the sheet discharge tray 110, is set as L1, and a length in the sheet discharge direction of a sheet F, which is a minimum size of sheet among a group of sheets that is loaded into the sheet discharge tray 110, is set as L2. As described above, the direction in which sheets P are aligned differs based on the sheet size thereof, the sheet E that has the maximum size is aligned on the downstream side and the sheet F that has the minimum size is aligned on the upstream side. In this case, a position of L2 from the first contact alignment board 12 toward the downstream side is set as a position A, and a position of L1 from the second contact alignment board 13 toward the upstream side in the sheet discharge direction is set as a position B. In order for the alignment roller 11 to align the sheet E and the sheet F, it is necessary that the alignment roller 11 be positioned further on the upstream side than the position A and further on the downstream side than the position B.

Figure 10:
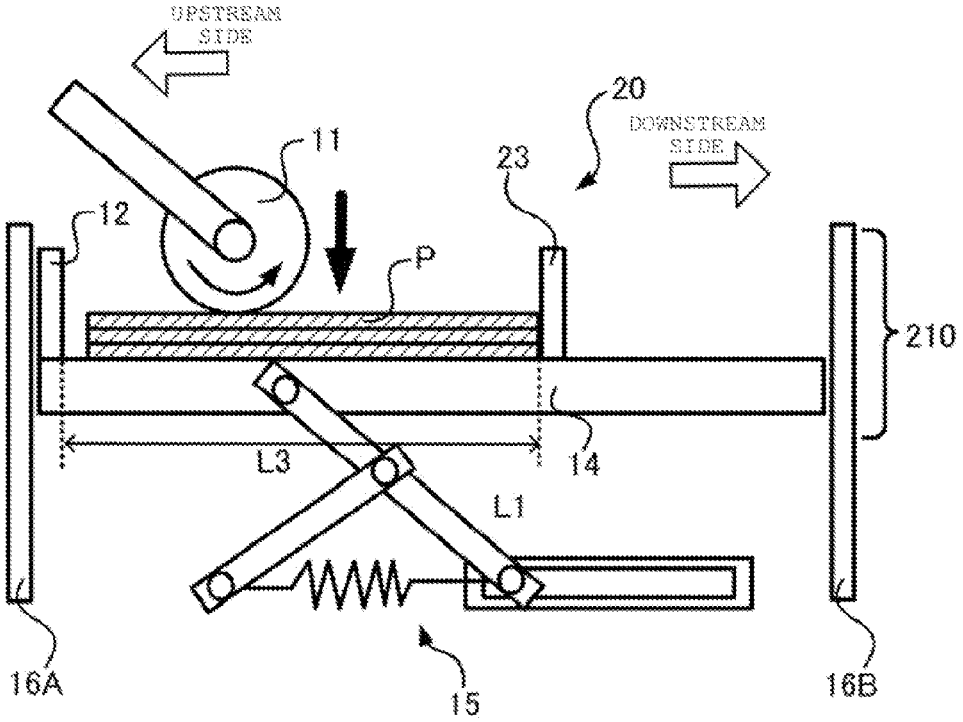
FIG. 10 is a schematic view of a sheet discharge mechanism in the related art.

FIG. 10 is a schematic view illustrating a sheet discharge mechanism 20 of the related art.

Members that have the same functions as the functions of the sheet discharge mechanism 10 illustrated in FIG. 6 are given the same reference symbols, and description thereof is omitted.

In the related art, the sheet discharge mechanism 20 is provided with a third contact alignment board 23 at a position that matches the size of a discharged sheet P. however, in this case, if a distance from the first contact alignment board 12 to the third contact alignment board 23 is set as L3, it is not possible to load sheets P of which the length in the sheet discharge direction is greater than L3 into a sheet discharge tray 210.

(Second Embodiment)

In the same manner as the first embodiment, in a second embodiment, sheets P that are less than or equal to a predetermined sire are aligned on an upstream side, and sheets P that are not less than or equal to a predetermined size are aligned on a downstream side. However, in the second embodiment, the loading board includes a first loading board 141 and a second loading board 142, and the second loading board 142 follows the first loading board 141 in an upward and downward movement.

Figure 11:
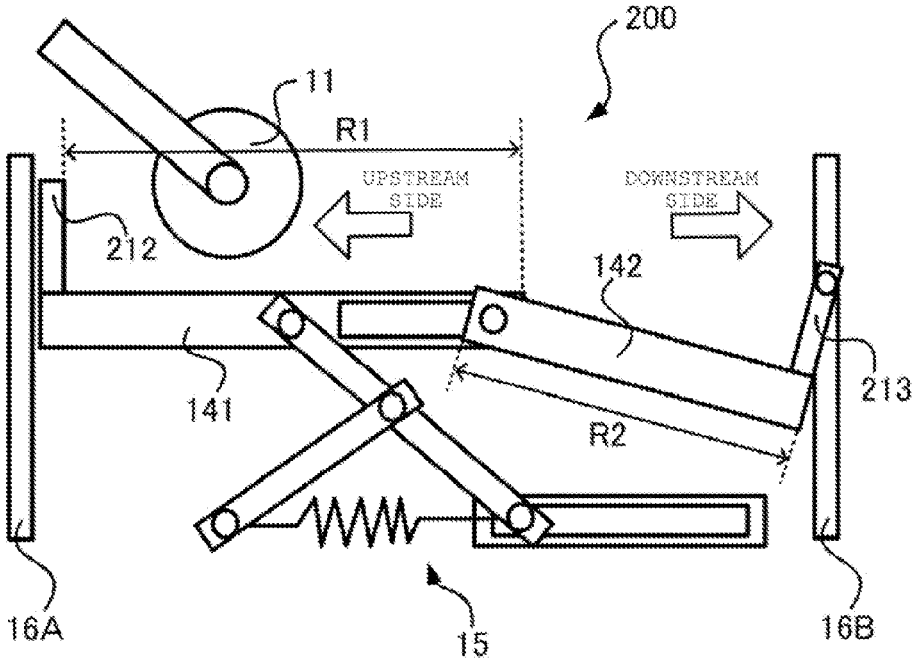
FIG. 11 is a schematic view of a sheet discharge mechanism according to a second embodiment.

FIG. 11 is a schematic view of a sheet discharge mechanism 200 according to the second embodiment.

Members that have the same functions as the functions according to the first embodiment are given the same reference symbols, and description thereof is omitted.

The sheet discharge mechanism 200 includes an alignment roller 11, the first loading board 141, the second loading board 142, a first contact alignment board 212, a second contact alignment board 213, a support mechanism 15, a guide board 16A and a guide board 16B.

The first contact alignment board 212 is vertically arranged at an end of the first loading board 141 on the upstream side. In addition, the second contact alignment board 213 is vertically arranged at an end of the second loading board 142 on the downstream side. The second loading board 142 is positioned further on the downstream side than the first loading board 141, and an end portion of the second loading board 142 on the upstream side is rotatably connected to an end portion of the first loading board 141 on a downstream side. The support mechanism 15 supports the first loading board 141 in a manner in which the first loading board 141 descends according to increases in the weight of sheets P that are loaded on the first loading board 141. The second loading board 142 follows the first loading board 141. in an upward and downward movement.

Next, the lengths of the first loading board 141 and the second loading board 142 in the sheet discharge direction will foe described. The length of the first loading board 141 in the sheet discharge direction is set as R1 and the length of the second loading board 142 in an inclined direction is set as R2 . In order to load sheets P to be aligned on the upstream side on the first loading board 141, it is necessary for the length R1 to be greater than the length in the sheet discharge direction of sheets P to be aligned on the upstream side. In addition, it is necessary for the total length of the length R1 and the length R2 to be longer than a length in the sheet discharge direction of the maximum size of a sheet among a sheet P group that is loaded into the sheet discharge mechanism 200.

In addition, in the second embodiment, the sheet loading surface of the second loading board 142 is inclined so that the downstream side is lower than the upstream side, and a sheet loading surface of the first loading board 141 is supported, horizontally. However, the inclinations of the first loading board 141 and the second loading board 142 are not limited thereto. For example, it is sufficient if the first loading board 141 is inclined so that the upstream side is lower than the downstream side with respect to a horizontal surface. As long as the sheets P that are arranged on the upstream side do not shift and fall to the downstream side, the inclination may be increased so that the upstream side is higher than the downstream side. In addition, the second loading board 142 may also be horizontal, or may be inclined so that the upstream side is lower than the downstream side.

In addition, as described above, in the second embodiment, an end portion on the upstream side of the second loading board 142 is rotatably connected to an end portion of the first loading board 141 on a downstream side. However, the first loading board 141 and the second loading board 142 need not necessarily be rotatably connected. For example, it is sufficient if the first loading board 141 and the second loading board 142 are fixed and continuous.

In addition, the first contact alignment board 212 and the second contact alignment board 213 need not necessarily be provided at the end portions of the first loading board 141 and the second loading board 142, and it is sufficient if the first contact alignment board 212 and the second contact alignment board 213 are provided in positions in which it is possible to align the discharged sheets P in the sheet discharge mechanism 200.

Figure 12:
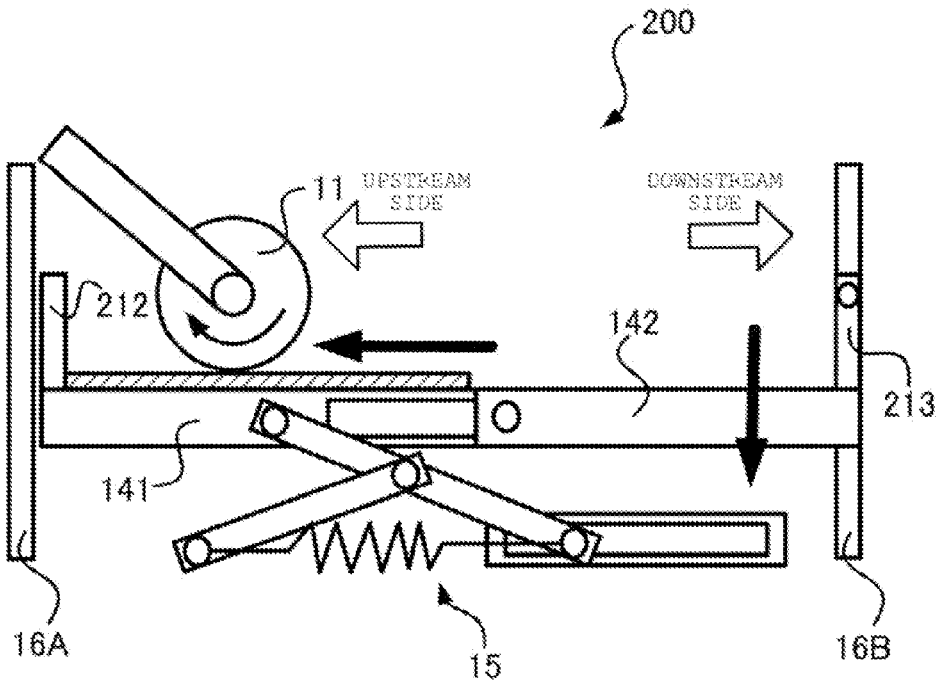
FIG. 12 illustrates the sheet discharge mechanism in a state in which sheets are aligned, according to the second embodiment.

FIG. 12 is a view illustrating a state in which the sheet discharge mechanism 200 according to the second embodiment aligns sheets P on the upstream side.

When a sheet P is discharged onto the sheet loading board 14 (the first loading board 141 and the second loading board 142), the alignment roller 11 rotates while applying pressure to the sheet P resulting in the sheet P being aligned on the upstream side. More specifically, the alignment roller 11 aligns the sheet P by abutting the sheet P against the first contact alignment board 212. At this time, the first loading board 141 descends according to increases in the weight of sheets P that are loaded on the first loading board 141, and the second loading board 142 follows the descent of the first loading board 141.

In FIG. 12, the sheet discharge mechanism 200 aligns a sheet P on the upstream side, but the embodiment is not limited to this configuration. In the same manner as in the first embodiment, sheets may be aligned on the upstream side or the downstream side based on sheet size in the second embodiment.

In the abovementioned embodiments, examples in which the sheet discharge mechanism 10 and the sheet discharge mechanism 200 load sheets that are discharged from a decolorization device 100 into a sheet discharge tray while performing alignment thereof, but the embodiments are not limited to such a configuration and for example, sheets discharged from an image forming apparatus may be loaded.

In addition, in the embodiments, the sheet discharge tray may have a shape in which discharged sheets may be loaded and is not limited to a tray shape. For example, the sheet discharge tray may be a shape such as a cassette-like shape.

In the present embodiment, when functions that execute the embodiment are stored in a device in advance is described, but the embodiment is not limited to this, and a configuration in which the same functions are downloaded to a device through a network or a configuration in which a recording medium on which the same functions are stored is installed on a device may be used. As a recording medium, provided the recording medium such, as a CD-ROM may store programs, and a device may read the recording medium, any form of recording medium may be used. In addition, functions that are obtained by installing in advance or downloading in this manner may be executed in cooperation with an operating system (OS) or the like inside a device.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described, herein may be made without departing from the spirit of the inventions. The accompanying claims and their equivalents are intended to cover such forms or modifications as would fall within the scope and spirit of the inventions.

What is claimed is:

1. A sheet discharge tray comprising:

a loading board configured to receive sheets that are discharged from a sheet transport path;

a first contact alignment board vertically positioned on the loading board at a first end portion on an upstream side in a sheet discharge direction;

a second contact alignment board vertically positioned on the loading board at a second end portion on a downstream side in the sheet discharge direction; and an alignment roller configured to align sheets that are less than or equal to a predetermined size to abut against the first contact alignment board by rotating in a first rotational direction and to align sheets that are greater than the predetermined size to abut against the second contact alignment board by rotating in a second rotational direction which is opposite to the first rotational direction.

2. The sheet discharge tray according to claim 1, wherein a loading surface of the loading board between the first contact alignment board and the second contact alignment board is horizontal.

3. The sheet discharge tray according to claim 1, wherein the loading board includes:

a first loading unit that includes the first contact alignment board, the first loading unit having a length in the sheet discharge direction longer than a length of a shortest sheet among a group of sheets that are loading targets; and a second loading unit that includes the second contact alignment board, the second loading unit being positioned further than the first loading unit on the downstream side in the discharge direction, a total length of the first loading unit and the second loading unit is longer than a length of a longest sheet among the group of sheets that are loading targets.

4. The sheet discharge tray according to claim 3, wherein a sheet loading surface of the second loading unit is inclined so that the downstream side in the discharge direction is lower than the upstream side in the discharge direction, and a sheet loading surface of the first loading unit is substantially horizontal.

5. The sheet discharge tray according to claim 3, wherein a sheet loading surface of the second loading unit is inclined so that the downstream side in the discharge direction is lower than the upstream side in the discharge direction, and a sheet loading surface of the first loading unit is inclined in a direction opposite to that of the second loading unit with respect to a horizontal plane.

6. The sheet discharge tray according to claim 3, wherein the end portion of the second loading unit on the upstream side in the discharge direction is rotatably connected to the end portion of the first loading unit on the downstream side in the discharge direction.

7. The sheet discharge tray according to claim 6, wherein a sheet loading surface of the second loading unit is inclined so that the downstream side in the discharge direction is lower than the upstream side in the discharge direction, and a sheet loading surface of the first loading unit is substantially horizontal.

8. A sheet discharge mechanism comprising:

a sheet discharge tray including:

a loading board configured to receive sheets that are discharged from a sheet transport path, a first contact alignment board vertically positioned on the loading board at a first end portion on an upstream side in a sheet discharge direction, and a second contact alignment board vertically positioned on the loading board at a second end portion on a downstream side in the sheet discharge direction;

a size information acquisition unit configured to acquire information related to the size of sheets discharged onto the loading board;

an alignment roller configured to align sheets to abut against the first contact alignment board and to align sheets to abut against the second contact alignment board; and a control unit configured to determine a size of a sheet based on the information acquired by the size information acquisition unit and to control the alignment roller to align sheets to abut against the first contact alignment board or to align sheets to abut against the second contact alignment board, based on the determined size of the sheet compared to a predetermined size.

9. The sheet discharge mechanism according to claim 8, wherein the control unit controls the alignment roller to align the sheet to abut against the first contact alignment board if the sheet is determined to be equal to or shorter than the predetermined size or to align the sheet to abut against the second contact alignment board if the sheet is determined to be longer than the predetermined size.

10. The sheet discharge mechanism according to claim 8, wherein the predetermined size is a length of the first loading unit.

11. The sheet discharge mechanism according to claim 8, wherein the loading board includes:

a first loading unit that includes the first contact alignment board, the first loading unit having a length in the sheet discharge direction longer than a length of a shortest sheet among a group of sheets that are loading targets; and a second loading unit that includes the second contact alignment board, the second loading unit being positioned further than the first loading unit on the downstream side in the discharge direction, a total length of the first loading unit and the second loading unit is longer than a length of a longest sheet among the group of sheets that are loading targets.

12. The sheet discharge mechanism according to claim 11, wherein a sheet loading surface of the second loading unit is inclined so that the downstream side in the discharge direction is lower than the upstream side in the discharge direction, and a sheet loading surface of the first loading unit is substantially horizontal.

13. The sheet discharge mechanism according to claim 11, wherein a sheet loading surface of the second loading unit is inclined so that the downstream side in the discharge direction is lower than the upstream side in the discharge direction, and a sheet loading surface of the first loading unit is inclined in a direction opposite to that of the second loading unit with respect to a horizontal plane.

14. The sheet discharge mechanism according to claim 11, wherein the end portion of the second loading unit on the upstream side in the discharge direction is rotatably connected to the end portion of the first loading unit on the downstream side in the discharge direction.

15. A decolorization device comprising:

a decolorization unit configured to decolorize a decolorizable toner image on a sheet by applying heat and pressure to the image;

a sheet discharge tray including:

a loading board configured to receive sheets discharged from the decolorization unit, a first contact alignment board vertically positioned on the loading board at a first end portion on an upstream side in a sheet discharge direction, and a second contact alignment board vertically positioned on the loading board at a second end portion on a downstream side in the sheet discharge direction;

a size information acquisition unit configured to acquire information related to the size of sheets discharged onto the loading board;

an alignment roller configured to align sheets to abut against the first contact alignment board and to align sheets to abut against the second contact alignment board; and a control unit configured to determine a size of a sheet based on the information acquired by the size information acquisition unit and to control the alignment roller to align sheets to abut against the first contact alignment board or to align sheets to abut against the second contact alignment board, based on the determined size of the sheet compared to a predetermined size.

16. The decolorization device according to claim 15, wherein:

the predetermined size is a length of the first loading unit, and the control unit controls the alignment roller to align the sheet to abut against the first contact alignment board if the sheet is determined to be equal to or shorter than the predetermined size or to align the sheet to abut against the second contact alignment board if the sheet is determined to be longer than the predetermined size.

17. The decolorization device according to claim 15, wherein the loading board includes:

a first loading unit that includes the first contact alignment board, the first loading unit having a length in the sheet discharge direction longer than a length of a shortest sheet among a group of sheets that are loading targets; and a second loading unit that includes the second contact alignment board, the second loading unit being positioned further than the first loading unit on the downstream side in the discharge direction, a total length of the first loading unit and the second loading unit is longer than a length of a longest sheet among the group of sheets that are loading targets.

18. The decolorization device according to claim 17, wherein a sheet loading surface of the second loading unit is inclined so that the downstream side in the discharge direction is lower than the upstream side in the discharge direction, and a sheet loading surface of the first loading unit is substantially horizontal.

19. The decolorization device according to claim 17, wherein a sheet loading surface of the second loading unit is inclined so that the downstream side in the discharge direction is lower than the upstream side in the discharge direction, and a sheet loading surface of the first loading unit is inclined in a direction opposite to that of the second loading unit with respect to a horizontal plane.

20. The decolorization device according to claim 17, wherein the end portion of the second loading unit on the upstream side in the discharge direction is rotatably connected to the end portion of the first loading unit on the downstream side in the discharge direction.

* * * * *